US009868564B2

(12) United States Patent
McGirr et al.

(10) Patent No.: US 9,868,564 B2
(45) Date of Patent: Jan. 16, 2018

(54) METAL CONTAINER

(71) Applicant: Crown Packaging Technology, Inc., Alsip, IL (US)

(72) Inventors: Laura Jane McGirr, Londonberry (GB); Tristan Robert Ellison, Shropshire (GB); Christopher Paul Ramsey, Oxfordshire (GB)

(73) Assignee: Crown Packaging Technology, Inc., Alsip, IL (US)

( * ) Notice: Subject to any disclaimer, the term of this patent is extended or adjusted under 35 U.S.C. 154(b) by 0 days.

(21) Appl. No.: 14/399,082

(22) PCT Filed: May 3, 2013

(86) PCT No.: PCT/EP2013/059227
§ 371 (c)(1),
(2) Date: Nov. 5, 2014

(87) PCT Pub. No.: WO2013/167478
PCT Pub. Date: Nov. 14, 2013

(65) Prior Publication Data

US 2015/0321789 A1 Nov. 12, 2015

(30) Foreign Application Priority Data

May 8, 2012 (EP) ..... 12167163

(51) Int. Cl.
*B65D 41/18* (2006.01)
*B65D 8/00* (2006.01)
(Continued)

(52) U.S. Cl.
CPC ..... *B65D 7/04* (2013.01); *B65D 1/0223* (2013.01); *B65D 1/165* (2013.01); *B65D 41/165* (2013.01);
(Continued)

(58) Field of Classification Search
CPC .... B65D 43/0204; B65D 7/04; B65D 41/165; B65D 51/1688
(Continued)

(56) References Cited

U.S. PATENT DOCUMENTS 1,985,818 A * 12/1934 Coyle ..... B65D 43/0212 220/786
3,181,719 A 5/1965 Schaich
(Continued)

FOREIGN PATENT DOCUMENTS

CN 200981699 11/2007
DE 327109 C 10/1920
(Continued)

OTHER PUBLICATIONS

International Patent Application No. PCT/EP2013/059227: International Search Report dated Jun. 19, 2013, 3 pages.

*Primary Examiner* — Fenn C Mathew
*Assistant Examiner* — Don M Anderson
(74) *Attorney, Agent, or Firm* — Baker & Hostetler LLP

(57) ABSTRACT

A metal container body 1 comprises a base and a generally cylindrical side wall 3. The top edge of the cylindrical side wall is rolled over to form a hollow annular bead 5 surrounding the upper open end of the container body and a notch 6 is formed at a circumferential point in the annular bead. The container body is for use with a releasable closure 2 formed with an end wall 7 and a depending skirt 8 and having an annular layer of sealing material 9 provided on the inside of the end wall adjacent the skirt. When the closure is pressed onto the container body, the annular bead engages the annular layer of sealing material and some of that material extends into the notch 6. The closure is held on the container only by the partial vacuum formed therein during processing of a food product in the container. After processing, the user opens the container by rotating the closure.
(Continued)

Sealing material in the notch forces the closure to lift off from the container to break the seal and release the closure.

18 Claims, 7 Drawing Sheets

(51) Int. Cl.

| | |
|---|---|
| ***B65D 43/02*** | (2006.01) |
| ***B65D 1/02*** | (2006.01) |
| ***B65D 1/16*** | (2006.01) |
| ***B65D 41/16*** | (2006.01) |
| ***B65D 41/17*** | (2006.01) |
| ***B65D 51/16*** | (2006.01) |

(52) U.S. Cl.
CPC ..... *B65D 41/17* (2013.01); *B65D 43/0204* (2013.01); *B65D 51/1688* (2013.01); *B65D 2543/00425* (2013.01); *B65D 2543/00546* (2013.01); *B65D 2543/00953* (2013.01)

(58) Field of Classification Search
USPC ..... 220/785, 786, 788
See application file for complete search history.

(56) References Cited

U.S. PATENT DOCUMENTS

| | | | | |
|---|---|---|---|---|
| 3,181,720 | A * | 5/1965 | Cassie | B65D 1/0246 215/260 |
| 3,464,582 | A * | 9/1969 | Greitzer | B65D 43/0212 220/786 |
| 3,631,650 | A | 1/1972 | Leftault, Jr. | |
| 3,690,497 | A | 9/1972 | Lecinski, Jr. | |
| 4,227,616 | A | 10/1980 | Lecinski, Jr. | |
| 4,444,325 | A | 4/1984 | Lecinski, Jr. | |
| 4,452,365 | A | 6/1984 | Ascasibar-Verdejo | |
| 4,552,279 | A | 11/1985 | Mueller | |
| 4,576,299 | A | 3/1986 | Lecinski, Jr. | |
| 4,603,786 | A | 8/1986 | Lecinski, Jr. | |
| 7,357,272 | B2 * | 4/2008 | Maxwell | B65D 43/0208 220/366.1 |
| 7,798,319 | B1 * | 9/2010 | Bried | A24F 23/00 131/352 |
| 2003/0155322 | A1 | 8/2003 | Auer et al. | |
| 2007/0289978 | A1 | 12/2007 | Fuchs | |
| 2011/0011274 | A1 * | 1/2011 | Thelen | A47J 27/09 99/337 |
| 2011/0168582 | A1 * | 7/2011 | Bannister | G01F 11/082 1/82 |
| 2011/0168708 | A1 * | 7/2011 | Antal, Sr. | B65D 43/0212 220/254.7 |
| 2011/0278255 | A1 | 11/2011 | Forrest et al. | |

FOREIGN PATENT DOCUMENTS

| | | | |
|---|---|---|---|
| EP | 2431297 | A1 | 3/2012 |
| GB | 454809 | A | 10/1936 |
| WO | WO 2013/167478 | A1 | 11/2013 |
| WO | WO 2013/167483 | A1 | 11/2013 |

* cited by examiner

METAL CONTAINER

CROSS-REFERENCE TO RELATED APPLICATIONS

This application is the National Stage of International Application No. PCT/EP2013/059227, filed May 3, 2013, which claims the benefit of European application number 12167163.0, filed May 8, 2012, the disclosures of which are incorporated herein by reference in their entirety.

TECHNICAL FIELD

The invention relates to a metal container body for use with a releasable closure containing an annular layer of sealing compound.

BACKGROUND ART

A container comprising a metal can body having a generally cylindrical side wall with a top edge rolled over to form an annular bead surrounding the upper open end of the body is known for use with a press-on cap closure which is sealed to the can body and held in position solely by a vacuum which is formed in the head space above the product in the container during processing. The cap is formed with a vacuum release means comprising a small opening in the end wall of the closure which is normally closed by a tear-out plastic insert or a pealable patch. After release of the vacuum, the closure is pried off the container body. Metal containers formed with a screw thread for connection to a closure are also known but the formation of the screw thread on the container neck is very difficult to achieve and tends to damage the internal coatings of the container which protect the metal of the container from the container contents.

Containers are also well known in which a metal, releasable cap closure containing a layer of sealing compound is fitted to a glass container body. Traditionally, the cap is screw fitted onto the body such that the upper surface of the neck of the container seals against the layer of sealing compound. Filling speeds for such containers are generally up to about 500 containers per minute.

Because of the time taken to fit a screw closure during production, a modified arrangement has been developed in which a closure is formed with sealing compound moulded to the outer part of the closure end wall and to the inside of the closure sidewall or skirt. This kind of closure may be push fitted onto a screw threaded container during production of a filled container. Filling speeds for such containers may be up to about 1,000 containers per minute. The screw threads of the body dig into the sealing compound to form at least a partial thread therein such that, when the container comes to be opened, relative rotation of the closure and container body will break the seal and allow the closure to be removed. This arrangement is useful for certain food products where a partial vacuum is maintained in the container after filling and closure. During the filling process of the container, steam is injected into the open container in the head space above the hot food product which has been measured into the container. The closure is then pressed down onto the container and, as the steam condenses, a partial vacuum is formed in the container above the head space which acts to hold the closure firmly in place on the container body. In the fully cooled filled container, the typical vacuum in the container is about 0.3 bar. This partial vacuum must be vented to allow the cap closure to be removed.

DISCLOSURE OF INVENTION

The invention provides an arrangement in which neither the container, nor the closure needs to be provided with a screw thread nor any other mechanical engagement means for making a seal between the closure and the container body. The closure is simply pushed downwardly onto the filled container to form the seal. In the arrangement of the present invention, the closure is held on the container body by virtue of the partial vacuum formed in the container body during production of the filled container. The container body is provided with a discontinuity on its annular sealing surface which causes the seal to be broken and the interior of the body to be vented when the cap closure is rotated from the original closed position so that the cap closure is released.

According to the invention, there is provided a metal container body for use with a releasable closure containing an annular layer of sealing material; the body comprising a base and a generally cylindrical side wall; wherein the top edge of the cylindrical side wall is rolled over to form a hollow annular bead surrounding the upper open end of the container body; and wherein a discontinuity is formed in the bead in the form of one or more depressions and/or one or more protrusions.

The invention provides several advantages. The closure is removed from the body simply by twisting and there is no need to provide a vacuum release device in the end wall of the closure.

It is not necessary to provide a screw thread on the container neck. This greatly simplifies manufacture of the container body and saves on material since a shorter neck can be provided.

Having only an annular layer of sealing compound on the end wall of the cap closure means that the sealing compound need not be moulded but can form under gravity. This uses less compound, greatly simplifies manufacture and removes the scrap generated in the compound moulding process.

Since the cap closure does not require lugs to engage a thread, a very small radial gap can be provided between the skirt of the closure and the neck of the container body. This reduces the risk of ingress of foreign matter, bugs, etc. and also increases resistance to accidental damage.

The absence of any threads on the cap means it can have reduced height, thus saving in material.

The torque required to open a container made in accordance with the invention is considerably less than typically required to open a threaded container. For example, the opening torque for a 51 mm closure has been reduced from about 3.4 Nm to only about 1.0 Nm. Reduction in the opening torque allows the use of fewer lubricants in the compound. These lubricants are one of the principle causes of migration into the food during processing. Thus, the new design also has benefits for food safety.

BRIEF DESCRIPTION OF DRAWINGS

Embodiments of the invention are described below with reference to the accompanying drawings, in which.

MODE(S) FOR CARRYING OUT THE INVENTION

Figure 1:
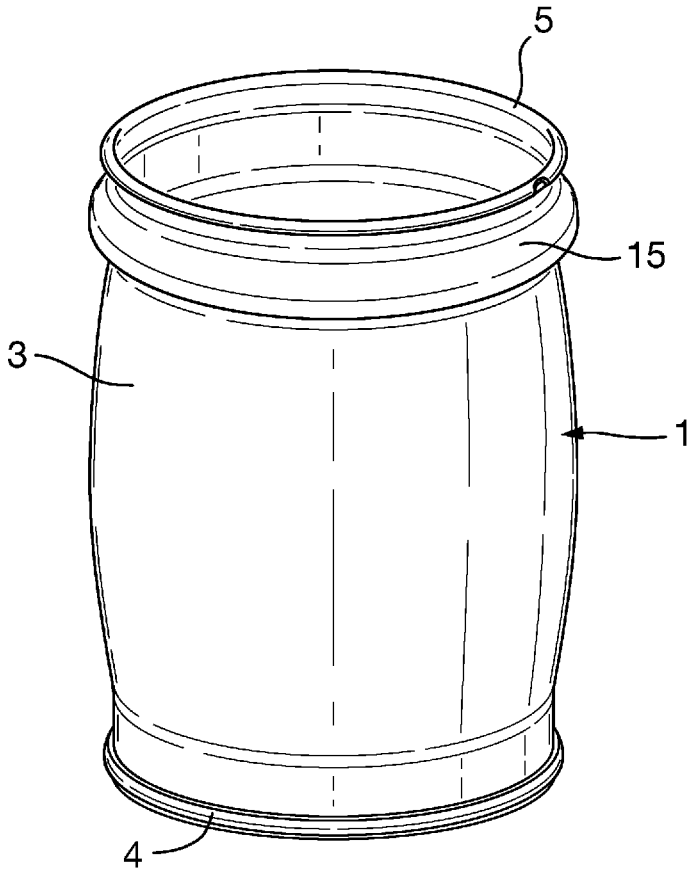
FIG. 1 is a perspective view of a container body.
Figure 2:
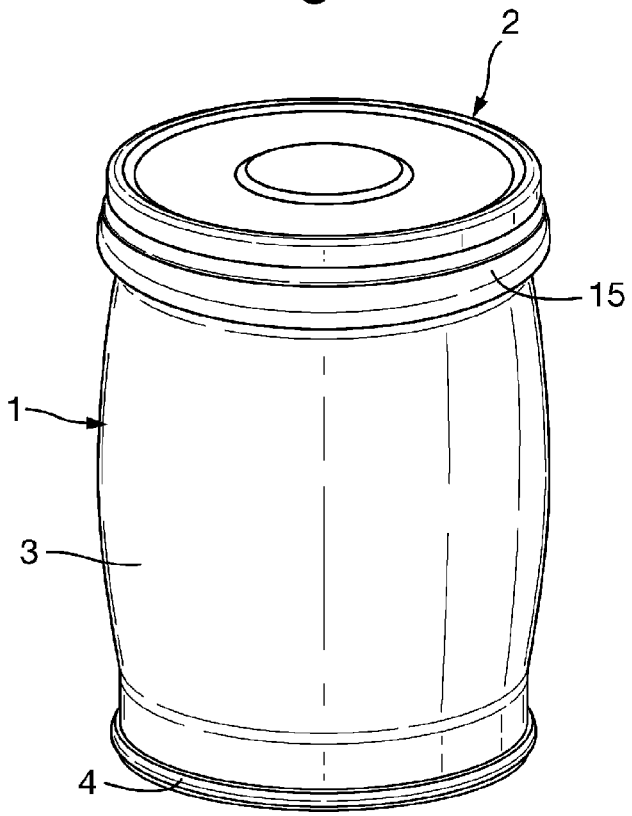
FIG. 2 is a perspective view of a container body and a closure.
Figure 3:
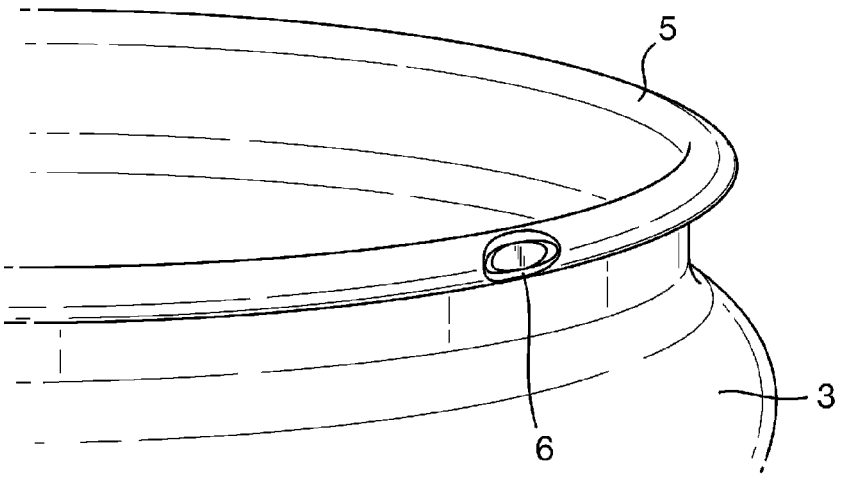
FIG. 3 is an enlarged partial view of an upper part of the container body.
Figure 4:
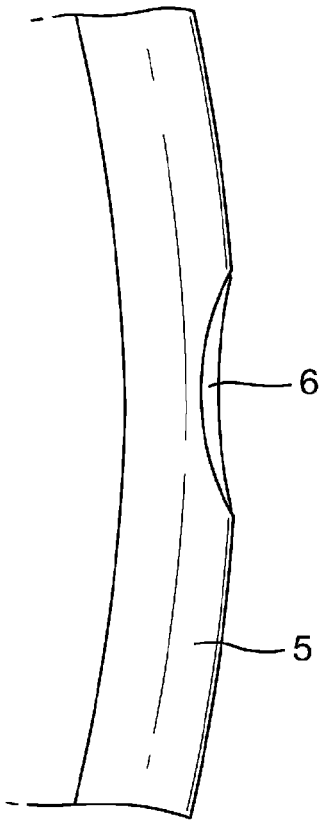
FIG. 4 is a further enlarged plan view of part of the rim of the container body.
Figure 5:
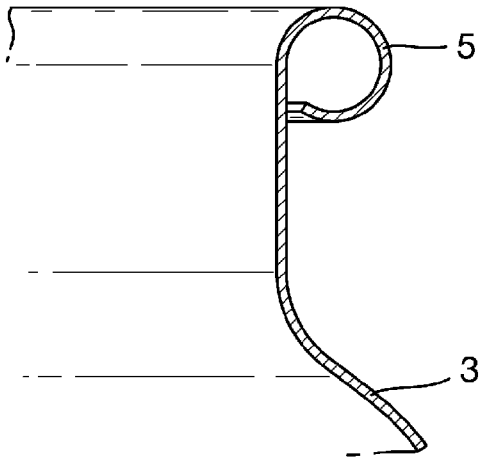
FIG. 5 is a sectional view through part of the upper part of the container body.
Figure 6:
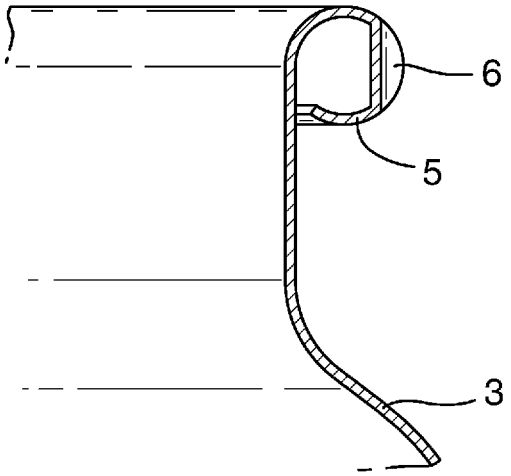
FIG. 6 is a view similar to FIG. 5 taken through the notch in the rim.

A container body 1 and a cap closure 2, both made of metal, are shown in the figures. The container body 1 has a side wall 3 made from a sheet of metal which is formed into a cylinder with the ends of the sheet overlapping slightly and welded together along a seam. This kind of manufacture is well known. The bottom end wall 4 of the container is seamed to the cylindrical side wall.

The upper end of the sidewall 3 has been rolled over outwardly to turn in the cut end of the side wall. The rolled over top of the end of the side wall forms a hollow annular bead or curl 5 which surrounds the upper open end of the container body to form the rim of the container, the upper surface of which provides an annular sealing surface. In an alternative (not shown) the top of the sidewall can be rolled over inwardly to form the annular bead. For example, a 73 mm diameter welded can body is made from 0.18 mm thick tinplate steel and has an upper bead or curl 5 with diameter of around 1.5 to 2 mm.

As shown, a single notch 6 is formed in the annular bead 5 at a circumferential point. The notch is formed as a small dent or recess facing generally radially outwardly. The depth of the notch is about 0.4 mm, roughly a quarter the diameter of the bead and it has a circumferential extent of approximately 4 to 5 mm, roughly twice the diameter of the bead.

The number and depth of the notches may be varied with the aim being to provide relatively easy rotation of the closure and venting within 5 seconds. Ideally, venting should be complete within 1 to 2 seconds. This can be achieved with a single notch having a depth of about 0.4 mm or two or three notches having a depth of about 0.2 mm.

The notch or notches can be formed in the bead, after curling of the upper end of the sidewall to form the bead, by pushing the bead into a suitable die.

In an alternative embodiment (not shown), the discontinuity in the bead is formed by one or more protrusions in the bead. These protrusions can be provided by squeezing or otherwise working the formed bead at one or more circumferential locations.

The cap closure 2 is formed with an end wall 7 and a depending skirt 8. An annular layer 9 of sealing material is provided on the inside of the end wall adjacent the skirt. When the closure 2 is pressed onto the container body during processing, the annular sealing surface on the annular bead engages the annular layer 9 of sealing material and some of that material extends into the notch to at least partially fills the notch as seen in FIG. 9*b*. If the bead is formed by one or more protrusions, the sealing material will extend at least partly around the protrusions.

The closure may be formed with a plurality of lobes at the bottom of the skirt. These lobes form clips which provide a loose snap-over fit with the bead of the body to assist in re-fitting the closure after opening. They do not, however, play any part in making a seal between the closure and the container body and must be moved upwardly past the bead after the seal has been broken. The closure is preferably made from tinplate steel.

The end wall has a central pop-up panel known as a "vacuum button" 10 which is normally held in a concave shape by the partial vacuum in the closed container. The button pops-up to a convex shape to give a warning that the vacuum has been vented and thus the seal has been broken. The closure must be made of steel rather than aluminium to provide this feature.

The sealing compound is a PVC plastisol and is applied to the closure through a nozzle and allowed to settle under gravity to form a generally even annular layer. It is cured before the filling process but will be softened during the filling and capping process by the steam in the head space above the food product so that it can flow into the notch 6 and set around the annular sealing surface 4 and within the notch.

Condensation of the steam causes a partial vacuum of about 0.3 bar in the headspace which forms a seal between the body and closure and holds the closure firmly on the body.

Following capping, the filled container is then normally processed according to the required food preservation conditions, for example products high in sugar, acid or salt may just need to be hot filled or pasteurised at 85 to 100° C. whereas meat based products which have no natural preservatives require a full sterilisation process at 121 to 130° C. to preserve the food product. Specific compound types have been developed to meet the differing processing conditions, for example a blown compound is typically used for pasteurised products as this has entrapped pockets of gas within the sealing layer which make the compound flexible in order to conform to the sealing surface at relatively low temperatures. For sterilised products less or no blowing agents may be used in order to form a stiffer sealing layer which is more resilient and suitable for higher temperature processing. The inventors have found that the stiffer non blown materials are particularly suitable for creating a venting feature. In this case the compound better retains the shape memory of the notch after processing and forms a stable vent path when the cap is first rotated as discussed below.

Other types of sealing gasket materials may also be used such as non-PVC flowed in materials, compression moulded TPE materials or separate elastomeric liner materials.

The container body 1 is formed with an annular bulge 15 below the annular bead 5 to protect the lower edge of the closure skirt from lateral impact during can handling This also provides hoop strength for the top portion of the can preventing it from going oval due to impact on the closure.

The can is specifically designed to have a high axial load capability to allow palletisation after closing and processing.

Typically loads of over 1.5 kN are achieved by use of shallow angular profiles within the sidewall where changes in geometry are no more than 30 degrees from vertical.

High panelling strength is required to withstand processing and distribution of the processed pack which will typically have a vacuum of around 0.3 bar, thus the container specification will be at least 0.5 bar. Panelling strength is provided by beading (multiple circumferential beads) or barrel shaping (large spherical profile).

Opening of the sealed container is discussed with reference to FIGS. 7 to 11. Prior to opening, a partial vacuum in the container is the sole mechanism which holds the closure 2 on the container body. The opening process requires the seal between the closure and the container body to be broken such that the partial vacuum is vented and the closure is released.

Figure 7:
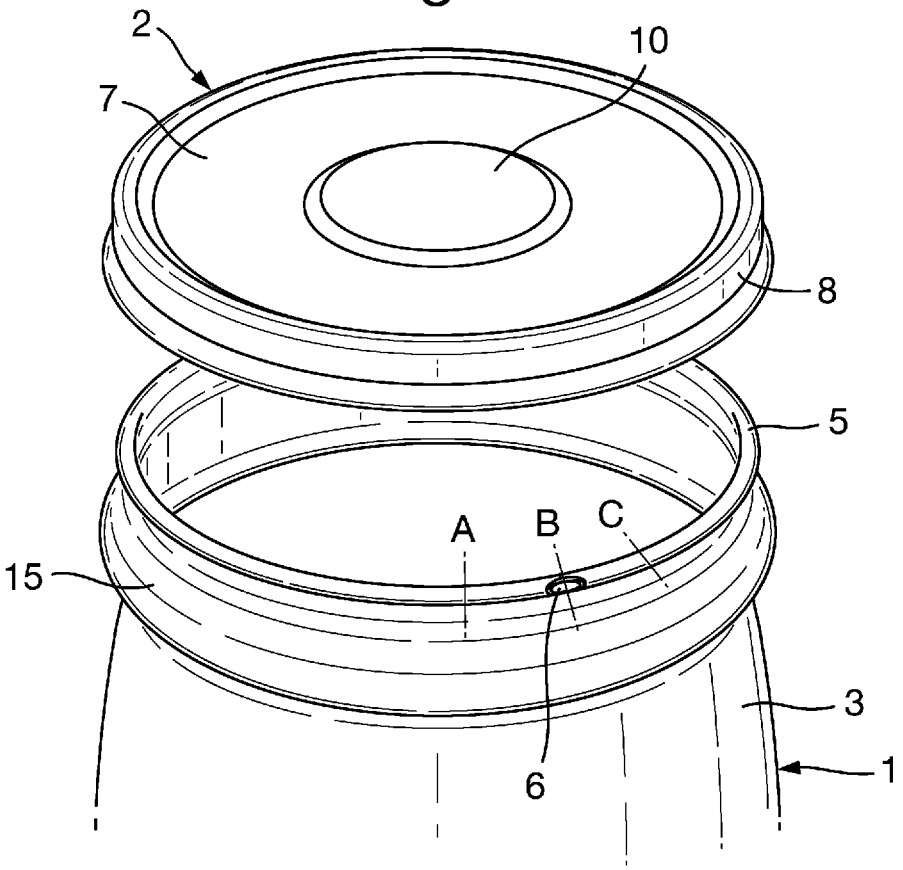
FIG. 7 is an exploded view of the upper part of the container and the closure.
Figure 8:
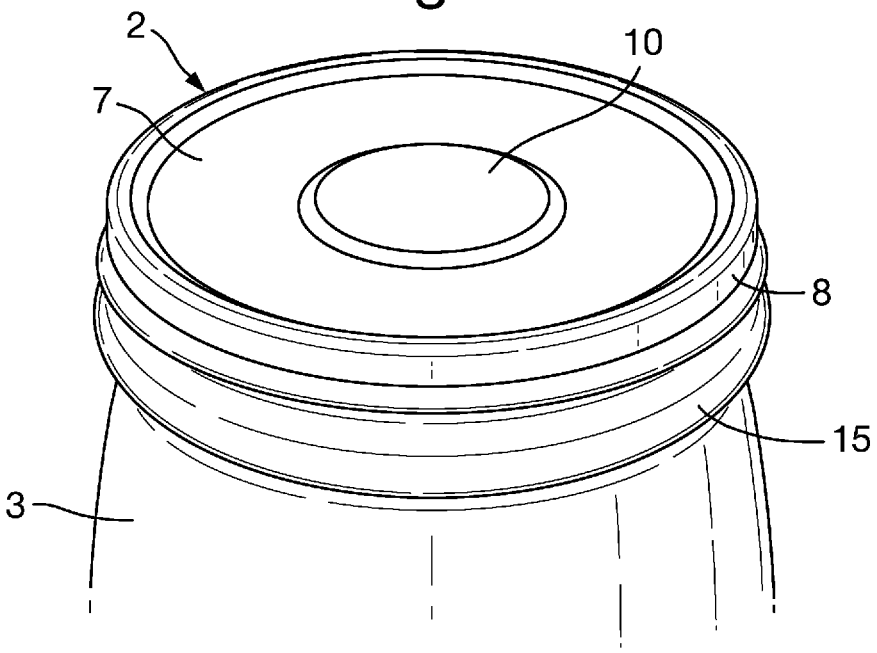
FIG. 8 is a perspective view of the upper part of the container and closure when fitted thereto.

In FIG. 7, positions A, B and C are indicated. The opening process requires rotation of the cap closure relative to the container body and it will be natural for the user to turn the closure anti-clockwise on the container body. In this case, the part of the closure originally at position A will move to position B and the part of the closure originally at position B (the notch position) will move to position C.

Figure 9A:
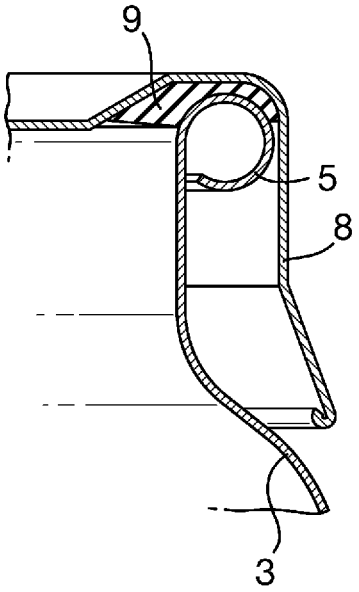
FIG. 9*a* is a sectional view through part of the upper part of the container and closure taken at the point A in FIG. 7.
Figure 9B:
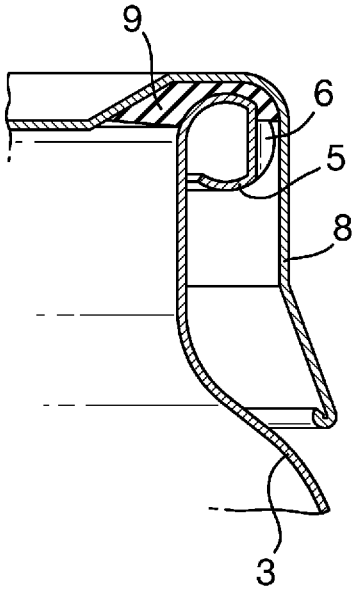
FIG. 9*b* is a sectional view through part of the upper part of the container and closure taken at the point B in FIG. 7.
Figure 9C:
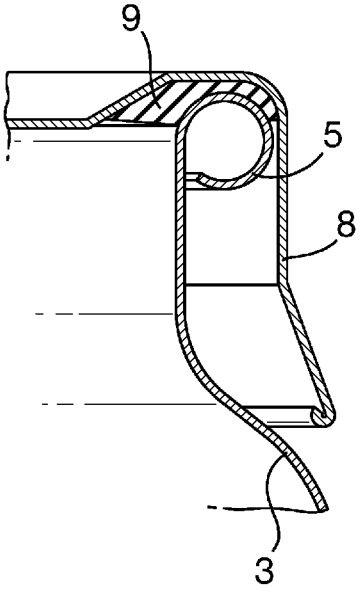
FIG. 9*c* is a sectional view through part of the upper part of the container and closure taken at the point C in FIG. 7.
Figure 10:
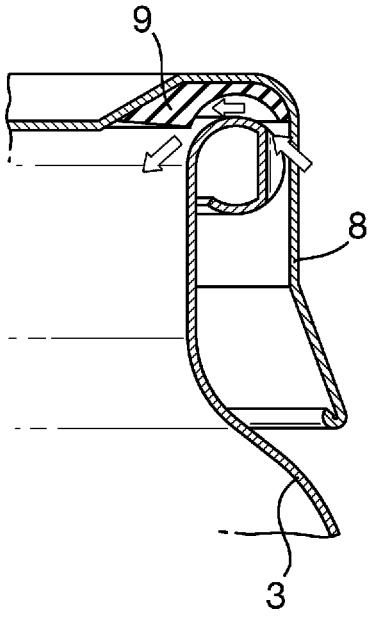
FIG. 10 is a sectional view through part of the upper part of the container and closure taken at the point B in FIG. 7 after the closure has been rotated anti-clockwise.
Figure 11:
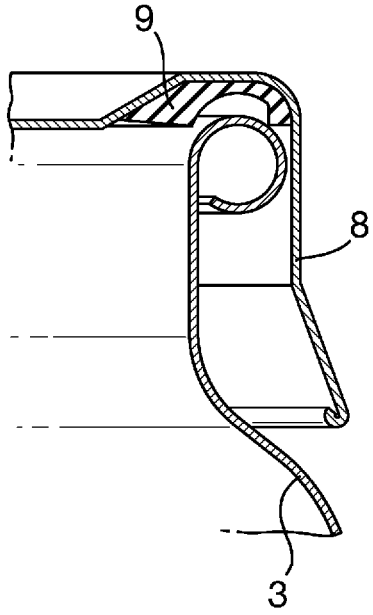
FIG. 11 is a sectional view through part of the upper part of the container and closure taken at the point C in FIG. 7 after the closure has been rotated anti-clockwise.

FIGS. 9*a*, 9*b* and 9*c* show sectional views through the container and closure at positions A, B and C before opening. It can be seen that the upper surface of the bead 5 forms a recess in the layer 9 of sealing material and that this recess is narrower at position B where the sealing material extends into the notch. As the closure is rotated anti-clockwise, the narrow recess at position B forces the closure of lift off the container to break the seal between the closure and the container as shown in FIG. 11. At the same time, the wider recess formed at position A forms a vent path when twisted round to position B due to the slight lift of the closure. This vent path is indicated by arrows on FIG. 10.

In the embodiment shown, only a single venting notch is provided because there is a load induced by each such notch so having just one reduces the overall load. Secondly, the axial load required for lifting the panel against the vacuum is lower if it is only on one side. Two or more notches may be provided but it is believed that the best solution is to have only one since this reduces the torque required to open the container. There is a risk, however, that a single notch will be perceived by the end user as a defect. This is likely to be somewhat mitigated if two or more notches are provided.

If the bead is formed with one or more protrusions rather than one or more depressions, the sealing material will extend at least partially around the protrusions and the mechanism occurring during opening of the container will be the same.

It will be understood that the closure cannot be properly resealed to the container body after opening and release of the vacuum. This arrangement is appropriate for food products which should be consumed immediately once the container has been opened although the closure may be replaced on the container and used as a cover, for example where food is stored in the fridge.

The invention claimed is:

1. A metal container comprising:

a body that is threadless, the body comprising:

a base having a center, the center partially defining a center axis of the body that extends through the center perpendicular to the base, and a generally cylindrical side wall having a top edge that is rolled over so as to form a hollow annular bead that defines an upper open end of the container body, the bead comprising a discontinuity in the form of one or more depressions, one or more protrusions, or a combination of at least one depression and at least one protrusions; and a releasable closure containing an annular layer of sealing material, wherein the annular layer of sealing material is a non-blown and a non-foamed material, wherein the body and the closure are configured such that when the closure is pressed onto the body, the annular bead engages the annular layer of sealing material and a portion of the sealing material extends into the one or more depressions, around the one or more protrusions, or into the at least one depression and around the at least one protrusion, and wherein the annular bead is configured such that as the releasable closure is rotated about the center axis, a vacuum in the body that is sufficient to seal the releasable closure to the can body is vented.

2. The container of claim 1, wherein the annular bead has a diameter of about 1.5 to 2 mm.

3. The container of claim 1, wherein the discontinuity is one or more notches defined by the bead.

4. The container of claim 3, wherein each of the one or more notches defines a depth of about 0.2 to 0.5 mm.

5. The container of claim 3, wherein each of the one or more notches has a circumferential length that is about twice a diameter defined by the annular bead.

6. The container of claim 1, wherein the container side wall is formed from a sheet of metal rolled into a cylinder and welded and the base seamed onto the side wall.

7. The container of claim 1, wherein the container has profiling in its side wall providing at least 0.5 bar of panelling performance.

8. The container of claim 3, wherein the bead has a maximum radial extent that is greater than a maximum radial extent of the one or more notches.

9. A container body and closure combination, the combination comprising:

a metal container body including a base having a center, the center partially defining a center axis of the body that extends through the center perpendicular to the base, and a generally cylindrical side wall having a top edge that is rolled over so as to form a hollow annular bead that defines an upper open end of the container body, the bead comprising a discontinuity in the form of one or more depressions, one or more protrusions, or a combination of at least one depression and at least one protrusions the metal container body being threadless;

a releasable closure including an end wall, a skirt that depends from the end wall, and an annular layer of sealing material disposed on an inside of the end wall adjacent the skirt, the annular layer of sealing material being a non-blown and a non-foamed material, the container body and closure configured such that when the closure is pressed onto the container body, the annular bead engages the annular layer of sealing material and a portion of the sealing material extends into the one or more depressions, around the one or more protrusions, or into the at least one depression and around the at least one protrusion; and a vacuum that forms a seal between the body and the releasable closure and holds the closure on the body, the container body and closure further configured such that as the releasable closure is rotated about the center axis, the vacuum is vented.

10. The combination of claim 9, wherein the annular sealing material permanently sets when cured and cooled.

11. The combination of claim 9, wherein the container body includes an annular bulge disposed below the annular bead, the annular bulge configured to protect the closure skirt from lateral impact.

12. The combination of claim 9, wherein the seal between the closure and the container body is also formed by the annular layer of sealing material.

13. The combination of claim 9, wherein the annular bead has a diameter of about 1.5 to 2 mm.

14. The combination of claim 9, wherein the discontinuity is one or more notches defined by the bead.

15. The combination of claim 14, wherein each of the one or more notches defines a depth of about 0.2 to 0.5 mm.

16. The combination of claim 14, wherein each of the one or more notches has a circumferential length that is about twice a diameter defined by the annular bead.

17. The combination of claim 9, wherein the container side wall is formed from a sheet of metal rolled into a cylinder and welded and the base is seamed onto the side wall.

18. The combination of claim 9, wherein the container has profiling in its side wall providing at least 0.5 bar of panelling performance.

* * * * *